US008693912B2

(12) United States Patent
Fujiwara

(10) Patent No.: US 8,693,912 B2
(45) Date of Patent: Apr. 8, 2014

(54) FIXING DEVICE AND IMAGE FORMING APPARATUS

(75) Inventor: Shigeru Fujiwara, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 107 days.

(21) Appl. No.: 13/493,059

(22) Filed: Jun. 11, 2012

(65) Prior Publication Data

US 2012/0321335 A1 Dec. 20, 2012

Related U.S. Application Data

(60) Provisional application No. 61/496,711, filed on Jun. 14, 2011.

(51) Int. Cl.
*G03G 15/20* (2006.01)

(52) U.S. Cl.
CPC .... *G03G 15/2078* (2013.01); *G03G 2215/2009* (2013.01)
USPC ..... 399/69; 399/329

(58) Field of Classification Search
CPC ..... G03G 15/2078; G03G 2215/2009
USPC ..... 399/69, 329
See application file for complete search history.

(56) References Cited

U.S. PATENT DOCUMENTS

2010/0290812 A1* 11/2010 Taguchi et al.
2012/0141154 A1* 6/2012 Yoshida ..... 399/69
2012/0141175 A1 6/2012 Fujiwara et al.
2012/0321350 A1* 12/2012 Ogasawara
2013/0017004 A1* 1/2013 Kaneko et al.

* cited by examiner

*Primary Examiner* — Susan Lee
(74) *Attorney, Agent, or Firm* — Amin, Turocy & Watson, LLP

(57) ABSTRACT

A fixing device of an embodiment is configured to fix an unfixed toner image formed of a decolorable toner on a sheet of paper. The fixing device includes: a fixing unit including a fixing member heated by a first heat source and a pressure member heated by a second heat source; a first temperature sensor and a second temperature sensor; and a temperature controller configured to control the first heat source and the second heat source separately for temperature control based on detected temperature information acquired by the temperature sensors, wherein the temperature controller controls the surface temperatures of the fixing member and the pressure member to set equal or above the temperature at which fixing is started fixing starting temperature and to set below the temperature at which decolorization is started, and such that the surface temperatures of the fixing member and the pressure member become substantially the same temperature.

11 Claims, 6 Drawing Sheets

FIXING DEVICE AND IMAGE FORMING APPARATUS

CROSS-REFERENCE TO RELATED APPLICATION

This application is based upon and claims the benefit of priority from: U.S. provisional application 61/496,711, filed on Jun. 14, 2011; the entire contents of which are incorporated herein by reference.

FIELD

Embodiments described herein relate generally to an image forming technique of forming an image on a sheet using a decolorable color material that is decolorized by being heated to predetermined temperatures.

BACKGROUND

A color material having a property in which its color is decolorized by applying heat to cut coupling between a pigment and a color forming agent is conventionally known. Use of such a color material as a developing agent in an image forming apparatus employing electrophotographic process enables reuse of printing sheets of paper. This reduces energy required for manufacture and recycling of sheets of paper, thereby contributing to reduction of carbon dioxide emissions.

If used in an image forming apparatus employing electrophotographic process, a decolorable developing agent using the aforementioned decolorable color material (such a developing agent is hereinafter called a decolorable toner) forms a developed image on an image supporting member such as a photosensitive drum. The developed image formed of the decolorable toner is transferred to a printing sheet of paper at a transfer position. The printing sheet of paper holding the unfixed decolorable toner image is conveyed to a fixing unit. Then, the fixing unit applies heat of predetermined fixing temperature and pressure to the unfixed decolorable toner image, thereby fixing the unfixed decolorable toner image on the printing sheet of paper. Fixing of the unfixed decolorable toner image is started at temperature lower than that of heat to be applied to start decolorization of the fixed decolorable toner image.

Regarding a non-decolorable toner image, fixing of the non-decolorable toner image may be started at relatively high temperatures. Accordingly, even if temperature varies during continuous printing and duplex printing, or even (low) ambient temperature changes, fixing performance can be maintained at a satisfactory level.

Meanwhile, regarding an unfixed decolorable toner image, fixing of the unfixed decolorable toner image is started at temperature that generally does not differ largely from temperature at which decolorization is started. Thus, temperature control of the fixing unit in consideration of temperature at which decolorization is started has been required.

DETAILED DESCRIPTION

A fixing device according to the present embodiment is configured to fix an unfixed toner image formed of a decolorable toner on a sheet of paper by applying heat and pressure to the toner image. The decolorable toner is melted by being heated to a predetermined temperature at which fixing is started, and is decolorized by being heated to a predetermined temperature at which decolorization is started and which is higher than the temperature at which fixing is started.

The fixing device includes: a fixing unit with a fixing member heated by a first heat source and a pressure member heated by a second heat source, the fixing member and the pressure member forming a nip portion through which a sheet of paper is passed; a first temperature sensor configured to detect the surface temperature of the fixing member; a second temperature sensor configured to detect the surface temperature of the pressure member; and a temperature controller configured to control the first heat source and the second heat source separately for temperature control based on detected temperature information acquired by the first temperature sensor and the second temperature sensor, wherein the temperature controller controls the surface temperatures of the fixing member and the pressure member to set equal or above the temperature at which fixing is started fixing starting temperature and to set below the temperature at which decolorization is started, and such that the surface temperatures of the fixing member and the pressure member become substantially the same temperature.

An image forming apparatus according to the present embodiment will now be described in detail based on the drawings.

First Embodiment

Figure 1:
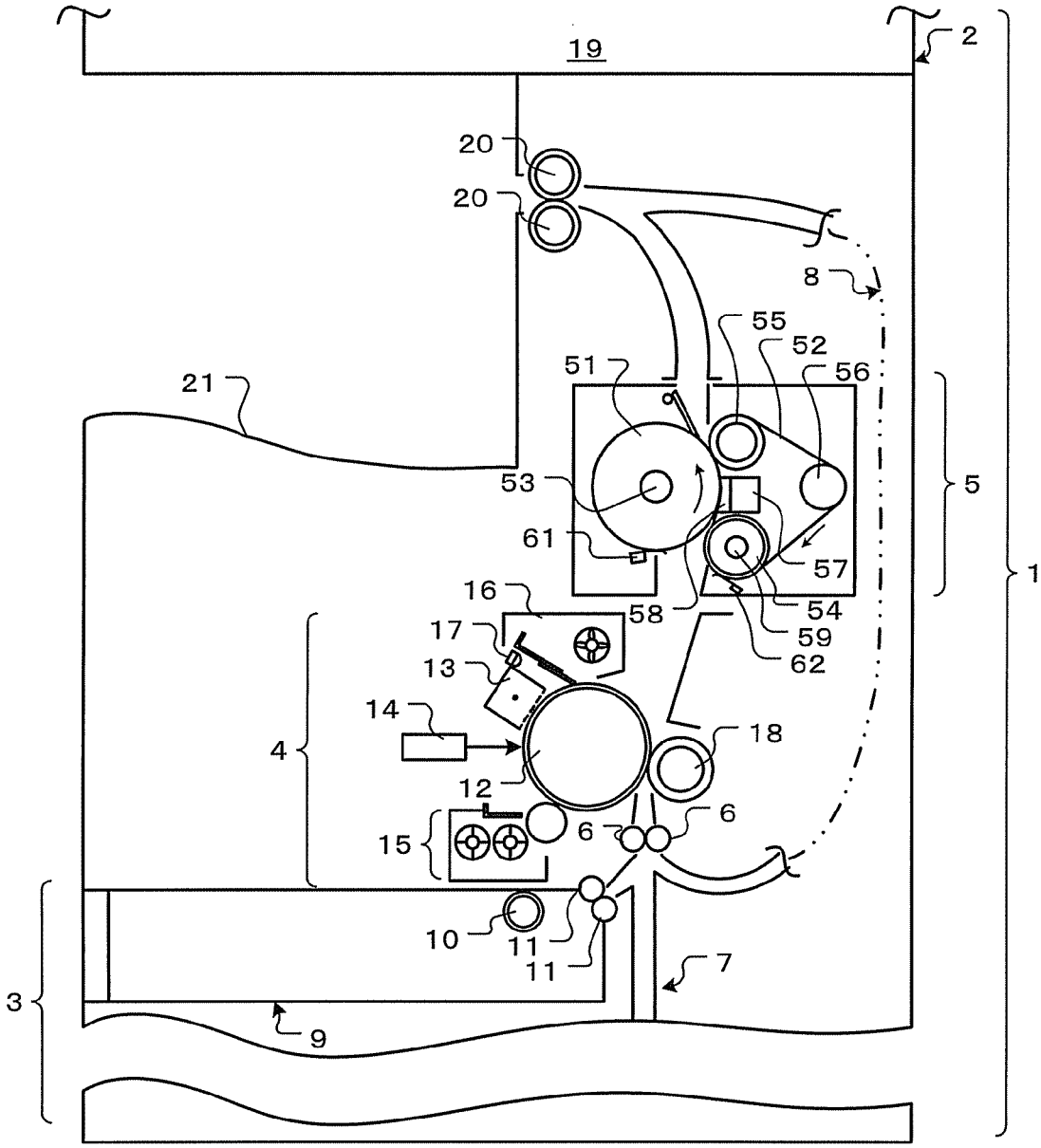
FIG. 1 is a schematic cross-sectional side view of a first embodiment showing the entire configuration of an image forming apparatus.

FIG. 1 is a schematic cross-sectional side view of a first embodiment showing the entire configuration of an image forming apparatus.

The image forming apparatus 1 employs an electrophotographic process, and includes a sheet feeding device 3, an image forming unit 4, and a fixing unit 5 of a fixing device that are arranged in the vertical direction of an apparatus body 2 as shown in FIG. 1. The image forming apparatus 1 further includes a sheet feeding and conveying unit 7 that conveys a sheet of paper taken out by the sheet feeding device 3 toward a pair of resist rollers 6, and a duplex sheet feeding unit 8 that realizes printing on both sides of a sheet of paper. The sheet feeding and conveying unit 7 and the duplex sheet feeding unit 8 are arranged at the back of the apparatus body 2 (on the right side of FIG. 1).

The sheet feeding device 3 has a plurality of sheet feeding cassettes 9 (only the top sheet feeding cassette is shown in FIG. 1) arranged in the vertical direction. The sheet feeding device 3 causes a pickup roller 10 to pick up sheets of paper stacked in the sheet feeding cassettes 9 one by one that are, for example, unused sheets of paper or reusable sheets of paper (after being subjected to decolorization process realized by decolorizing a decolorable toner images fixed on the sheets of paper). Then, the sheet feeding device 3 feeds the sheets of paper picked up to a pair of separating and conveying rollers 11, and conveys the sheets of paper to the pair of resist rollers 6 through the sheet feeding and conveying unit 7.

The image forming unit 4 has a photosensitive drum 12 with an organic photoconductor (OPC) formed on a surface thereof. The photosensitive drum 12 rotates at a predetermined peripheral speed of 136 m/sec, for example. The image forming unit 4 further has: a scorotoron corona charger 13 provided on the circumference of the photosensitive drum 12, with the corona charger 13 uniformly charging the photosensitive drum 12 to a negative potential; a laser exposure unit 14 for exposure of an image on a surface of the photosensitive drum 12; a developing unit 15 containing a decolorable toner; a cleaner 16 that removes the toner left on the photosensitive drum 12 without being transferred; a neutralizing lamp 17 that neutralizes the photosensitive drum 12; and a transfer roller 18 that transfers a toner image supported on the surface of the photosensitive drum 12 to a sheet of paper.

An image signal given from a personal computer, or an image signal formed by converting an image of an original read by a scanner 19 arranged at upper part of the apparatus body 2 to digital form, is subjected to an image processing at an image processing circuit not shown in the drawings. Then, the image signal is transmitted to a laser driving circuit not shown in the drawings. A laser (semiconductor laser) not shown in the drawings emits light in response to the image signal, and the laser exposure unit 14 performs scan and exposure with the laser light at a resolution of 600 dpi, for example, thereby forming an electrostatic latent image on the photosensitive drum 12.

The electrostatic latent image formed on the photosensitive drum 12 is made visible by being developed with a decolorable toner in the developing unit 15. The developing unit 15 contains a two-component developing agent composed of a mixture of a decolorable toner of a volume average grain diameter of from 5 to 12 μm and a magnetic carrier of a volume average grain diameter of from 30 to 80 μm, and the decolorable toner is negatively charged. A toner concentration sensor not shown in the drawings provided to the developing unit 15 detects the toner concentration of the two-component developing agent. In response to the output of detection of the toner concentration sensor, the developing unit 15 is replenished with a decolorable toner supplied from a toner cartridge not shown in the drawings.

For duplex printing, the transfer roller 18 with positive transfer bias applied from a high-voltage power supply not shown in the drawings transfers a toner image formed of a decolorable toner formed on the photosensitive drum 12 to a first side of a sheet of paper while the sheet of paper passes through a transfer nip portion. The pair of resist rollers 6 conveys the sheet of paper having been placed on standby to the transfer nip portion at a given point in time. The sheet of paper on which the toner image has been transferred is conveyed to the fixing unit 5, and the fixing unit 5 fixes the toner image formed of the decolorable toner and transferred to the first side of the sheet of paper.

In the image forming process of the present embodiment, the cleaner 16 removes the toner left on the photosensitive drum 12 without being transferred, and thereafter, the neutralizing lamp 17 irradiate the photosensitive drum 12 with light to neutralize the photosensitive drum 12. Further, the corona charger 13 charges the photosensitive drum 12 uniformly, making the photosensitive drum 12 prepared for formation of a next electrostatic latent image. However, this is not the only example of image forming process of the embodiment.

The sheet of paper with the fixed image is conveyed toward a pair of sheet discharging rollers 20. For single-sided printing, the pair of sheet discharging rollers 20 discharges the sheet of paper onto a sheet discharge tray 21. For duplex printing, the sheet of paper is fed to the duplex sheet feeding unit 8 employing a switchback system for printing on a second side thereof. Then, the sheet of paper is placed on standby between the pair of resist rollers 6. The sheet of paper is thereafter conveyed to the transfer nip portion in accordance with timing of transfer to the second side thereof. A toner image formed of a decolorable toner is transferred to the second side, and thereafter, the sheet of paper is conveyed to the fixing unit 5. Then, the toner image on the second side of the sheet of paper is fixed, and the pair of sheet discharging rollers 20 discharges the sheet of paper onto the sheet discharge tray 21.

Figure 2:
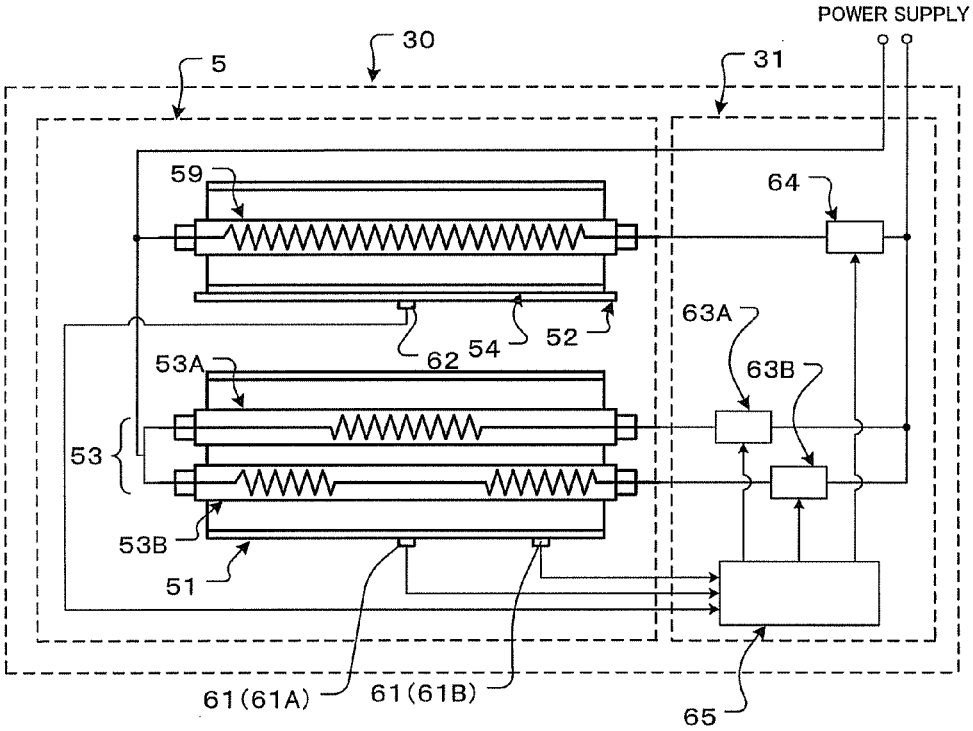
FIG. 2 shows a fixing unit and an energization controller provided in a fixing device of the image forming apparatus of FIG. 1.

As shown in FIG. 2, a fixing device 30 of the embodiment includes the fixing unit 5, and an energization controller 31 that controls energization of the fixing unit.

The fixing unit 5 has a cylindrical heat roller 51 functioning as a fixing member, and an endlessly rotating pressure belt 52 functioning as a pressure member. The pressure belt 52 is in abutting contact with a predetermined range of the outer circumference of the heat roller 51 to form a fixing nip portion therebetween. The heat roller 51 has a heat roller-specific lamp 53 composed of a halogen lamp that is provided in the heat roller 51 as a heat source. The diameter of the heat roller 51 is 45 mm, for example, and that of the pressure belt 52 is 47 mm, for example.

The pressure belt 52 is wound under tension around a belt heat roller 54 placed at an upstream side in a sheet conveying direction, a pressure roller 55 placed at a downstream side in the sheet conveying direction, and a tension roller 56, thereby forming the fixing nip portion between the belt heat roller 54 and the pressure roller 55. The pressure roller 55 causes the pressure belt 52 to be brought in contact with the heat roller 51 under pressure to form an exit of the fixing nip portion. A pressure pad holder 57 placed inside the pressure belt 52 supports a pressure pad 58. The pressure pad holder 57 presses the pressure pad 58 against the pressure belt 52 at a central portion of the fixing nip portion, thereby causing the pressure belt 52 to be brought into contact with the heat roller 51 under pressure.

The belt heat roller 54 is formed as a hollow roller. The belt heat roller 54 has a pressure belt lamp 59 that is a halogen lamp and provided in the belt heat roller 54 as a heat source.

In the present embodiment, the diameter of the belt heat roller 54 is 20 mm, the diameter of the pressure roller 55 is 18 mm, and the width of the pressure pad 58 is 10 mm.

The surface temperature of the heat roller 51 is detected by a fixing member-specific thermistor 61 being in contact with the outer circumference of the heat roller 51. The surface temperature of the pressure belt 52 on the belt heat roller 54 is detected by a pressure member-specific thermistor 62 being in contact with the outer circumference of the pressure belt 52.

In the present embodiment, the length of the fixing nip portion determined in the sheet conveying direction is about 27 mm, for example, and time required for a horizontally oriented A4 sized sheet of paper to pass through the fixing nip portion is about 0.2 seconds, for example.

The heat roller 51 functioning as the fixing member is caused to be in contact with an unfixed toner image held on a sheet of paper. Therefore, the heat roller 51 has an aluminum roller base of an exemplary thickness of 1.0 mm, and a fluorine resin PFA (tetrafluoroethylene-perfluoroalkyl vinyl ether copolymer) layer of a thickness of about 25 μm formed as a releasing layer on the roller base. The pressure belt 52 functioning as the pressure member has a nickel belt base of a thickness of about 40 μm, a silicone rubber layer of a thickness of 200 μm formed on the belt base, and a fluorine resin PFA layer of a thickness of about 30 μm formed as a releasing layer on the silicone rubber layer.

As shown in FIG. 2, the heat roller 51 is caused to rotate by a drive source not shown in the drawings, and the pressure belt 52 is caused to rotate in response to the rotation of the heat roller 51.

The halogen lamp 53 provided in the heat roller 51 is composed of two lamps including a heat roller-specific center lamp 53A that heats a central portion in the direction of the length of the heat roller 51, and a heat roller-specific side lamp 53B that heats the opposite end portions in the direction of the length of the heat roller 51. The pressure belt lamp 59 provided in the belt heat roller 54 heats the belt heat roller 54 in the direction of the entire length of the belt heat roller 54. The heat roller-specific center lamp 53A is designed to correspond to a sheet width of a vertically oriented A4 sized sheet of paper, for example. The heat roller-specific side lamp 53B is designed to correspond to a horizontally oriented A4 sized sheet of paper, for example. Outputs of these three lamps are 300 W, for example.

A center lamp-specific switching element 63A, a side lamp-specific switching element 63B, and a pressure belt lamp-specific switching element 64 are independently controlled to be turned on and off, thereby supplying power or stopping supply of power from a commercial AC power supply to the heat roller-specific center lamp 53A, the heat roller-specific side lamp 538, and the pressure belt lamp 59, respectively. As an example, bi-directional thyristors are used as these switching elements.

The center lamp-specific switching element 63A, the side lamp-specific switching element 63B, and the pressure belt lamp-specific switching element 64 are turned on and off under control of a temperature controller 65.

The fixing member-specific thermistor 61 includes a heat roller-specific center thermistor 61A that detects the surface temperature of the heat roller 51 at the central portion thereof in the direction of the length of the heat roller 51, and a heat roller-specific side thermistor 613 that detects the surface temperature of the heat roller 51 at one of the opposite end portions thereof in the direction of the length of the heat roller 51. The fixing member-specific thermistor 61 enters detected temperature information acquired by the heat roller-specific center and side thermistors 61A and 618 into the temperature controller 65. If a sheet of paper to be subjected to fixing is a vertically oriented A4 sized sheet of paper, for example, the OFF period of the heat roller-specific side lamp 53B is made longer to prevent temperature increase to a temperature higher than necessary at the opposite end portions of the heat roller 51.

Figure 3:
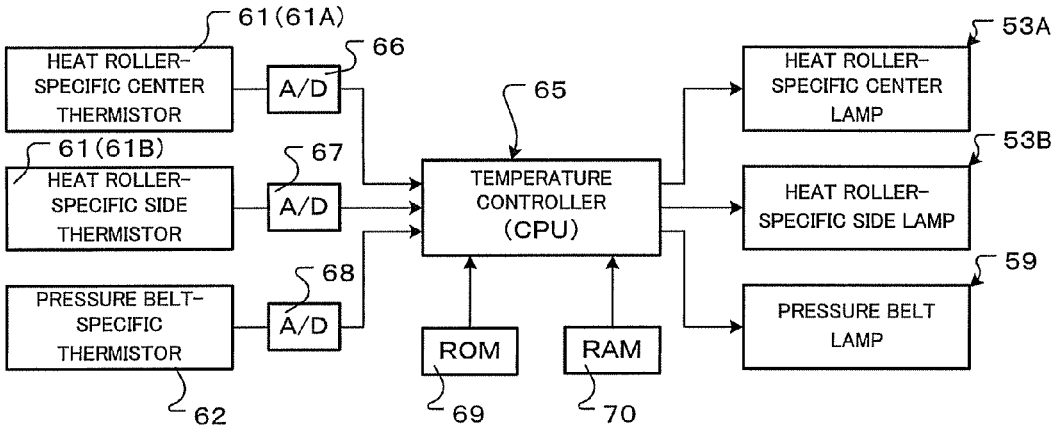
FIG. 3 is a circuit block diagram of the energization controller of FIG. 2.

The pressure member-specific thermistor 62 detects the surface temperature of the pressure belt 52 at a central portion thereof in the direction of the width of the pressure belt 52, and enters detected temperature information into the temperature controller 65. As shown in the circuit block diagram of FIG. 3, the thermistors 61A, 61B and 62 are connected through A/D converters 66, 67 and 68 respectively to the temperature controller 65. The temperature controller 65 is connected to a ROM 69 storing a program to be executed to realize temperature control, and a RAM 70 storing a control parameter for temperature control.

Figure 4:
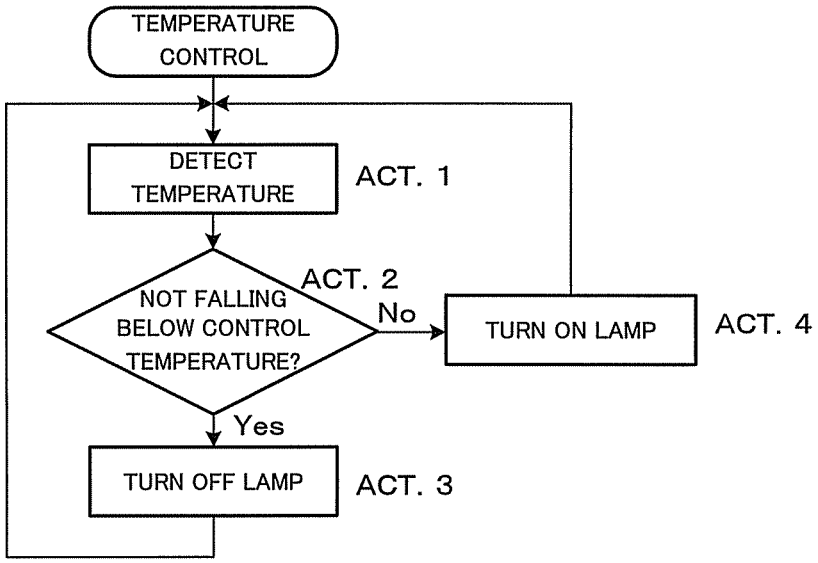
FIG. 4 is a flow chart explaining basic control by the energization controller of FIG. 3.

FIG. 4 is a flow chart explaining the basic operation for temperature control realized by the temperature controller 65.

The temperature controller 65 controls the respective temperatures of the heat roller-specific center lamp 53A and the heat roller-specific side lamp 53B and the pressure belt lamp 59 separately. The temperature controller 65 causes the thermistors 61A, 61B and 62 to detect these temperatures (ACT. 1). Then, the temperature controller 65 determines if the temperatures detected by the respective thermistors 61A, 61B and 62 do not fall below a predetermined control temperature (ACT. 2). If the detected temperatures do not fall below the predetermined control temperature, the temperature controller 65 turns off the lamps (ACT. 3). If the detected temperatures are lower than the predetermined control temperature, the temperature controller 65 keeps the lamps on until the temperatures of the lamps reach the control temperature (ACT. 4). In this way, the temperature controller 65 maintains the surface temperatures of the heat roller 51 and the pressure belt 52 at a predetermined temperature.

Melting of a toner forming a toner image by heating the toner depends on temperature observed between the toner image and a sheet of paper. Further, decolorization of a toner image formed of a decolorable toner depends on the surface temperature of the toner image. This means that, while fixing is performed favorably by increasing the surface temperature of the fixing member, temperature control should be performed such that the surface temperatures of the fixing member and the pressure member will not reach the temperature at which decolorization of a decolorable toner is started. In particular, the temperature at which decolorization is started does not differ largely from the temperature at which fixing is started. Thus, temperature control should be realized stably in a narrow temperature range.

It is desirable that a toner image formed of a decolorable toner be fixed at lowest possible temperatures in order to prevent decolorization of the toner image. Further, even if target surface temperatures of the fixing member and the pressure member are set at the same temperature for temperature control of the fixing member and the pressure member, the actual surface temperatures thereof do not become the target temperatures. However, with the smallest possible difference between the surface temperatures of the fixing member and the pressure member, these surface temperatures can be maintained more stably at low temperatures.

It is assumed that there is a difference between the surface temperatures of the fixing member and the pressure member while both of these surface temperatures are not lower than temperatures at which fixing is started. In this case, a relationship is established between the lower limits of the surface temperatures of the fixing member and the pressure member that enable fixing as shown by a fixing enabling lower limit temperature characteristic line L1 of FIG. 6.

Figure 6:
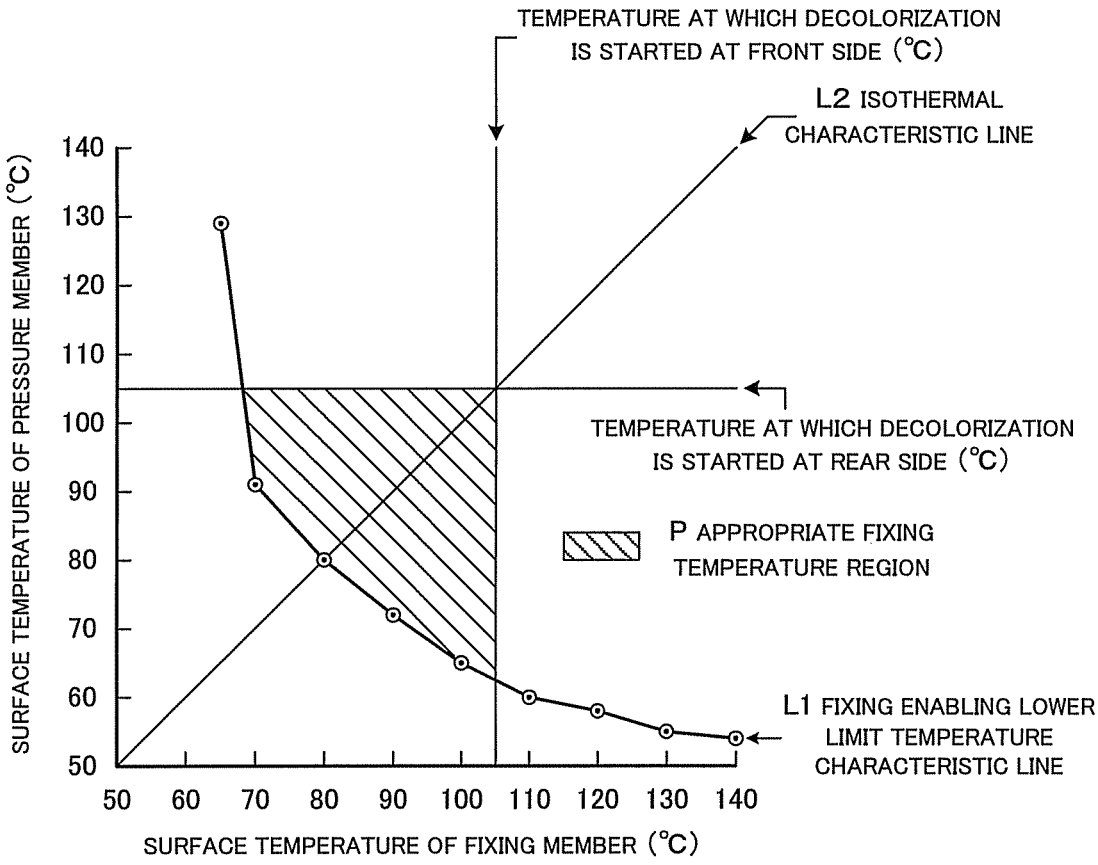
FIG. 6 shows an appropriate fixing temperature region of the fixing member and the pressure member achieved by the energization controller of FIG. 3.

Therefore, even if a difference is generated between the actual temperatures of the fixing member and the pressure member during fixing process performed with the target surface temperatures of the fixing member and the pressure member set at the same temperature, when this difference is within an appropriate fixing temperature region P indicated by dashed lines of FIG. 6, an unfixed decolorable toner image formed on a first side of a sheet of paper can be fixed without being decolorized. In the case of duplex printing, an unfixed decolorable toner image can be fixed on a second side while the fixed decolorable toner image on the first side and the unfixed toner image on the second side are not decolorized.

From this point of view, the temperature controller 65 sets the target surface temperatures of the heat roller 51 and the pressure belt 52 at the same temperature. As a result of this temperature control, even when the heat roller 51 functioning as the fixing member and the pressure belt 52 functioning as the pressure member are heated with the halogen lamps 53 and 59 respectively, a temperature difference between the actual surface temperature of the heat roller 51 and that of the pressure belt 52 can be minimized. This reduces heat transfer between the heat roller 51 and the pressure belt 52, so that the surface temperatures of the heat roller 51 and the pressure belt 52 can be maintained stably at low fixing temperatures. Thus, the surface temperatures of the heat roller 51 and the pressure belt 52 will not reach the temperatures at which decolorization is started. Fixing performed by heating only the heat roller 51 increases heat transfer to the pressure belt 52, while generating a fear of making the surface temperature of the heat roller 51 reach the temperature at which decolorization is started or higher than the temperature at which decolorization is started.

Fixing performance and decolorizing performance of a decolorable toner were evaluated based on an image density by using the image forming apparatus 1 of the structure shown in FIG. 1. A decolorable toner used was a thermally decolorable encapsulated toner formed by the chemical means as follows:

(1) Binder Resin and Liquid of Atomized Wax

A polyester resin was used as a binder resin. A liquid of atomized resin was formed with a high-pressure homogenizer by using the polyester resin, an anionic emulsifying agent, and a neutralizing agent.

(2) Preparation of Liquid of Dispersed Wax

A liquid of atomized rice wax was formed in the same manner as that in the formation of the aforementioned liquid of atomized resin.

(3) Preparation of Toner

Leuco dye: CVL (crystal violet lactone)

Color developing agent: benzyl 4-hydroxybenzoate

Temperature controlling agent: 4-benzyloxy phenylethyl laurate (4) The aforementioned materials were melted by heating, and then encapsulated by following known coacervation process. The encapsulated color material, the liquid of the dispersed toner binder resin, and the liquid of the dispersed wax were flocculated using aluminum sulfate ($Al_2(SO_4)_3$) and fused, and then washed and dried, thereby obtaining a toner. Appropriate additives were applied to the toner. The toner thereby obtained is hereinafter called an encapsulated decolorable toner. The absolute specific gravity of the encapsulated decolorable toner falls within a range of from about 0.9 to about 1.2 $gcm^3$. The toner was produced such that 10% by weight of the toner before application of the additives corresponds to the amount of the encapsulated color material. The characteristics of the encapsulated color material used for the toner are such that the decolorization of the color material is started at 90° C., and the color material is completely decolorized at temperatures ranging from 93 to 95° C.

Fixing performance and decolorizing performance of a decolorable toner were evaluated in the following manner. The fixing unit 5 was adjusted to be stabilized (stabilization of the fixing unit 5 will be described later with reference to FIG. 7) and the temperature controller 65 was adjusted such that the surface temperatures of the heat roller 51 and the pressure belt 52 are at the same temperature. Then, a toner image was fixed while fixing temperature was changed in a range of from 60 to 140° C. A sheet of paper used is P-505 (of a basis weight of 64 $g/m^2$, available from TOSHIBA CORPORATION). An image evaluated is an image formed by solid shading on the sheet of paper with the applied toner of an amount of 0.6 $mg/cm^2$. An evaluation result is shown in FIG. 5.

Figure 5:
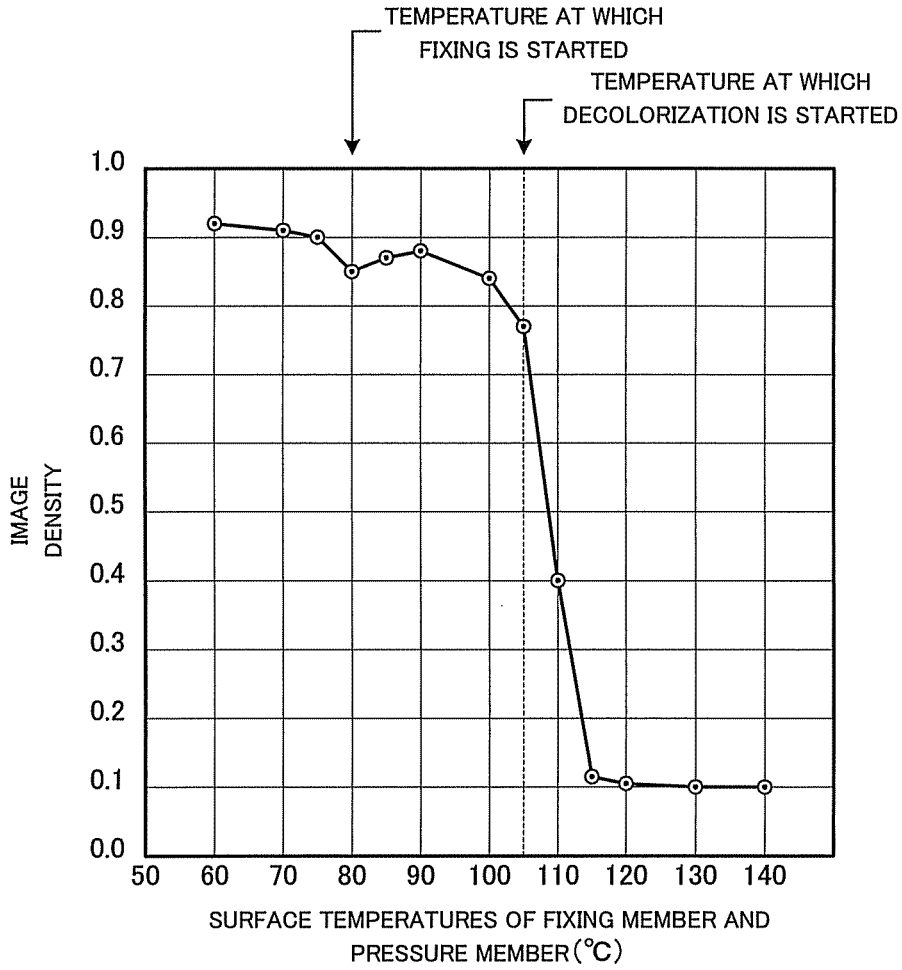
FIG. 5 shows a relationship between an image density observed after fixing is performed with the surface temperatures of a fixing member and a pressure member set at the same temperature by the energization controller of FIG. 3 and the surface temperatures of the fixing member and the pressure member.

In FIG. 5, the horizontal axis indicates the surface temperatures of the fixing member (heat roller) and the pressure member (pressure belt), and the vertical axis indicates an image density. Fixing performance (fixing strength) was evaluated by using a fastness tester, and it was determined that fixing performance is acceptable if 75% or higher percentage of an image density is maintained after the test.

As shown in FIG. 5, the surface temperature of the heat roller 51 functioning as the fixing member and that of the pressure belt 52 functioning as the pressure member were increased while these surface temperatures were set at the same temperature. Under this condition, fixing of a decolorable toner image was started at the surface temperatures of about 80° C. and decolorization was started at the surface temperatures of about 105° C. This means that there is a temperature difference of an absolute value of about 25° C. between the temperature at which fixing is started and the temperature at which decolorization is started.

Meanwhile, if the temperature controller 65 controls the surface temperatures of the heat roller 51 and the pressure belt 52 at the same predetermined target temperature, the upper limits of the surface temperatures are set at temperatures lower than the temperature at which decolorization is started, and the lower limits thereof are set at temperatures not falling below the temperature at which fixing is started. In this case, the actual surface temperature of the heat roller 51 and that of the pressure belt 52 differ from the target temperature, and the surface temperatures of the heat roller 51 and the pressure belt 52 differ from each other.

It is assumed that both or one of the surface temperatures of the heat roller 51 and the pressure belt 52 does not fall below the temperature at which decolorization is started. In this case, any of a fixed decolorable toner image formed on a first side and an unfixed decolorable toner image formed on a second side that is in direct contact with the heat roller 51 or the pressure belt 52 at temperatures not falling below the temperature at which decolorization is started during duplex printing is decolorized.

Thus, the surface temperatures of the fixing member and the pressure member are controlled to fall within the appropriate fixing temperature region P indicated by dashed lines and defined by the fixing enabling lower limit temperature characteristic line L1 under conditions where the surface temperatures of the fixing member and the pressure member do not exceed the temperature at which decolorization is started. As a result, an unfixed decolorable image can be fixed while the unfixed decolorable image and a fixed decolorable toner image are not decolorized.

The appropriate fixing temperature region P is a region defined in a graph with the horizontal axis indicating the surface temperature of the fixing member and the vertical axis indicating the surface temperature of the pressure member. Specifically, The appropriate fixing temperature region P is defined by the lines of the temperatures at which decolorization is started (this temperature is 105° C. in FIG. 6) as the upper limit temperatures for the surface temperatures of the fixing member and the pressure member, and the fixing enabling lower limit temperature characteristic line L1 of approximately arc shape as the lower limit temperature.

In the present embodiment, the fixing enabling lower limit temperature characteristic line L1 is nearly a curved line passing through an intersecting point (80° C. in FIG. 6) of the temperatures at which fixing is started being the surface temperatures of the fixing member and the pressure member. Further, the fixing enabling lower limit temperature characteristic line L1 also connects the lower limit (69° C. in FIG. 6) of the surface temperature of the fixing member and the lower limit (64° C. in FIG. 6) of the surface temperature of the pressure member. Here, the lower limit of the surface temperature of the fixing member is lower than the temperature at which fixing is started and determined when the surface temperature of the pressure member is at its upper limit corresponding to the temperature at which decolorization is started (105° C.). The lower limit of the surface temperature of the pressure member is determined when the surface temperature of the fixing member is at its upper limit corresponding to the temperature at which decolorization is started (105° C.).

The graph of FIG. 6 includes an isothermal characteristic line L2 connecting points where the surface temperatures of the fixing member and the pressure member are at the same temperature. The isothermal characteristic line L2 divides the appropriate fixing temperature region P into two parts of the substantially same area. A wide area is maintained around the isothermal characteristic line L2, so that control temperature can be set in a wide permissible range, allowing reliable fixing of a toner image without decolorizing the same.

In order to control the surface temperatures to the same temperature in compliance with the isothermal characteristic line L2, the temperature controller 63 should control the surface temperatures such that a temperature difference between the surface temperature of the heat roller 51 and that of the pressure belt 52 observed during fixing process is made smaller than a temperature difference (25° C.) between the temperature at which decolorization is started (105° C.) and the temperature at which fixing is started (80° C.). As a result, the surface temperatures of the heat roller 51 and the pressure belt 52 stay in a fixing enabling range without exceeding the temperature at which decolorization is started, allowing fixing of a toner image without decolorizing the same.

Figure 7:
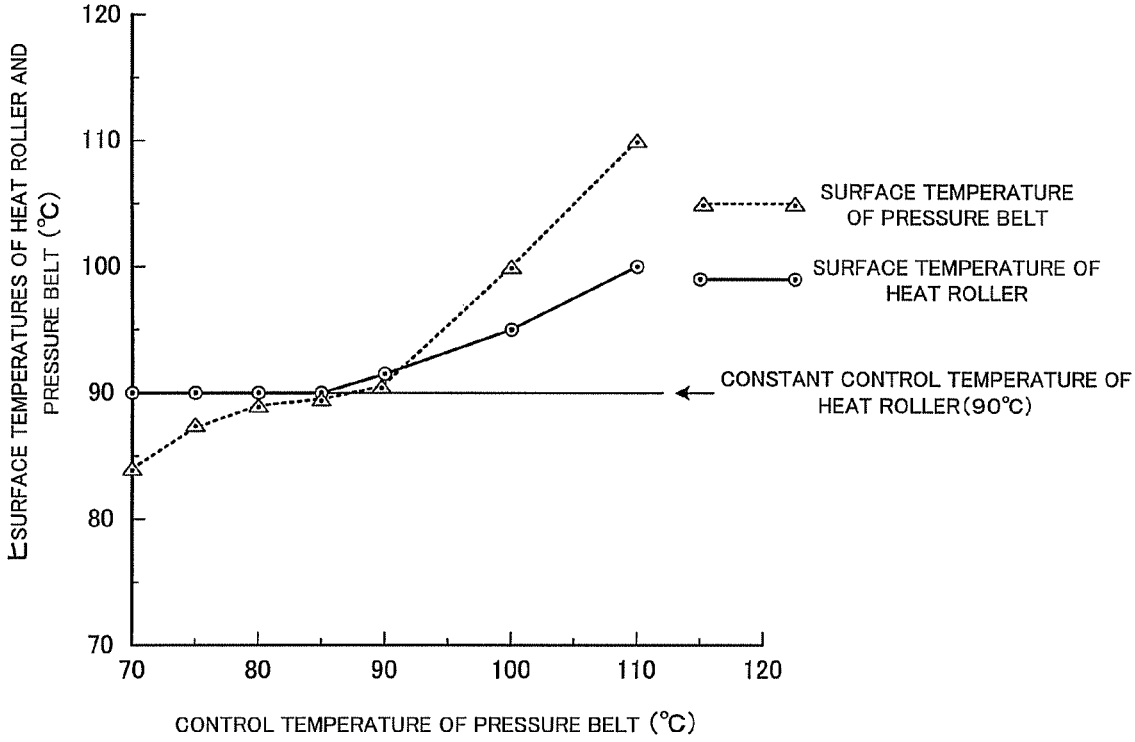
FIG. 7 shows an experimental result obtained by evaluating the temperatures of a heat roller and a pressure belt (temperature of the fixing unit) in comparison to the control temperature of the pressure belt with the control temperature of the heat roller set at constant temperature.

FIG. 7 is a graph explaining the temperature stability (stabilization) of the fixing unit 5. The graph of FIG. 7 provides an experimental result obtained by evaluating the surface temperatures of the heat roller 51 and the pressure belt 52 in comparison to the control temperature of the pressure belt 52 with the control temperature of the heat roller 51 set at a constant temperature (in the embodiment, 90° C.)

If the control temperature of the pressure belt 52 was set at 70° C. while that of the heat roller 51 was set at 90° C., the detected surface temperatures of the heat roller 51 and the pressure belt 52 were 90° C. and 84° C., respectively. If the control temperature of the pressure belt 52 was increased gradually to the temperature of 80° C. at which fixing is started and further to a temperature of 85° C., the surface temperature of the heat roller 51 was maintained at 90° C. At the same time, the surface temperature of the pressure belt 52 was increased gradually to about 90° C. while the control temperature of the pressure belt 52 was in a range of from 80° C. to 85° C.

If the control temperature of the pressure belt 52 was increased further to 90° C., the surface temperature of the pressure belt 52 was maintained at about 90° C. while the surface temperature of the heat roller 51 was increased slightly to a temperature higher than its control temperature of 90° C.

If the control temperature of the pressure belt 52 was gradually increased further from 90° C., the surface temperature of the pressure belt 52 started to increase. At the same time, the surface temperature of the heat roller 51 also started to increase but was maintained at a temperature lower than those of the surface temperature of the pressure belt 52, thereby increasing a temperature difference between the surface temperatures of the pressure belt 52 and the heat roller 51. This temperature difference was about 5° C. and about 7° C. with the control temperature of the pressure belt 52 being 100° C. and 105° C., respectively.

During fixing of a decolorable toner image while the surface temperatures of the heat roller 51 and the pressure belt 52 are set at the same temperature in compliance with the isothermal characteristic line L2 of FIG. 6, the surface temperatures equally become 90° C. by setting both the control temperatures of the heat roller 51 and the pressure belt 52 at 90° C. The surface temperatures of the heat roller 51 and the pressure belt 52 can be set at the same temperature in a range of from 90° C. to 105° C. by setting the control temperature of the pressure belt 52 at temperatures lower by some temperature in an exemplary range of from 5 to 10° C. than the surface temperature of the heat roller 51.

Namely, the heat capacity of the pressure belt 52 is smaller than that of the heat roller 51. Accordingly, if the temperature of the pressure belt 52 is made lower than that of the heat roller 51, heat can be transferred from the heat roller 51 to the pressure belt 52. In this case, it is considered that the surface temperature of the pressure belt 52 approaches the surface temperature of the heat roller 51.

In the embodiment described above, the fixing unit 5 includes the fixing member using the heat roller 51 with a heat source therein, and the pressure member in the shape of an endless belt using the pressure belt 52. The fixing unit 5 may have a reverse combination of the fixing member and the pressure member. In this case, the fixing member and the pressure member are composed of a belt and a roller, respectively. Alternatively, the fixing member and the pressure member may be composed of belts, or of rollers.

The fixing device of the present embodiment functions as a fixing device for use in fixing toner images only. However, the fixing device of the present embodiment may also function as a device capable of decolorizing a fixed decolorable toner image on a sheet of paper by applying heat to the toner image.

The embodiments may be embodied in other various forms without departing from the spirit or essential characteristics thereof. The above-described embodiments are therefore to be considered in all respects as illustrative and not restrictive. The scope of the embodiments is indicated by the appended claims, but not restricted by the foregoing description. Further, all changes, various improvements, substitutions and modifications which come within the meaning and range of equivalency of the claims are therefore intended to be embraced therein.

What is claimed is:

1. A fixing device configured to fix an unfixed toner image formed of a decolorable toner on a sheet of paper by applying heat and pressure to the toner image, the decolorable toner being melted by being heated to a predetermined temperature at which fixing is started, the decolorable toner being decolorized by being heated to a predetermined temperature at which decolorization is started and which is higher than the temperature at which fixing is started, the fixing device comprising:

a fixing unit including a fixing member heated by a first heat source and a pressure member heated by a second heat source, the fixing member and the pressure member forming a nip portion through which a sheet of paper passes;

a first temperature sensor configured to detect a surface temperature of the fixing member;

a second temperature sensor configured to detect a surface temperature of the pressure member; and a temperature controller configured to control the first heat source and the second heat source separately for temperature control based on detected temperature information acquired by the first temperature sensor and the second temperature sensor, wherein the temperature controller controls the surface temperatures of the fixing member and the pressure member to set equal or above the temperature at which fixing is started fixing starting temperature and to set below the temperature at which decolorization is started, and such that the surface temperatures of the fixing member and the pressure member become substantially the same temperature.

2. The fixing device according to claim 1, wherein the temperature controller sets target surface temperatures of the fixing member and the pressure member at low temperatures.

3. The fixing device according to claim 1, wherein the temperature controller performs temperature control such that a temperature difference between the surface temperatures of the fixing member and the pressure member observed during fixing does not exceed a temperature difference between the temperature at which decolorization is started and the temperature at which fixing is started.

4. The fixing device according to claim 1, wherein the fixing unit is configured such that the surface temperature of the fixing member observed during fixing is higher than the surface temperature of the pressure member observed during fixing.

5. The fixing device according to claim 1, wherein the fixing member is composed of a roller member, and the pressure member is composed of an endlessly rotating pressure belt which is in contact with an outer surface of the roller member under pressure.

6. An image forming apparatus configured to form a toner image on a sheet of paper, the apparatus comprising:

an image forming unit configured to transfer a toner image formed on an image supporting member to a sheet of paper, the toner image being formed by using a decolorable toner as a developing agent, the decolorable toner being melted by being heated to a predetermined temperature at which fixing is started, the decolorable toner being decolorized by being heated to a predetermined temperature at which decolorization is started and which is higher than the temperature at which fixing is started;

a fixing unit including a fixing member heated by a first heat source and a pressure member heated by a second heat source, the fixing member and the pressure member forming a nip portion through which a sheet of paper passes, the fixing unit fixing an unfixed toner image transferred to a sheet of paper by the image forming unit on the sheet of paper by applying heat and pressure to the toner image;

a first temperature sensor configured to detect a surface temperature of the fixing member;

a second temperature sensor configured to detect a surface temperature of the pressure member; and a temperature controller configured to control the first heat source and the second heat source separately for temperature control based on detected temperature information acquired by the first temperature sensor and the second temperature sensor, wherein the temperature controller controls the surface temperatures of the fixing member and the pressure member to set equal or above the temperature at which fixing is started fixing starting temperature and to set below the temperature at which decolorization is started, and such that the surface temperatures of the fixing member and the pressure member become substantially the same temperature.

7. The image forming apparatus according to claim 6, comprising a duplex sheet feeding unit configured to feed a sheet of paper having passed through the fixing unit to a transfer position in the image forming unit for printing on a second side of the sheet of paper to realize printing on both sides of the sheet of paper.

8. The image forming apparatus according to claim 6, wherein the temperature controller sets the target surface temperatures of the fixing member and the pressure member at low temperatures.

9. The image forming apparatus according to claim 6, wherein the temperature controller performs temperature control such that a temperature difference between the surface temperatures of the fixing member and the pressure member observed during fixing does not exceed a temperature difference between the temperature at which decolorization is started and the temperature at which fixing is started.

10. The image forming apparatus according to claim 6, wherein the fixing unit is configured such that the surface temperature of the fixing member observed during fixing is higher than the surface temperature of the pressure member observed during fixing.

11. The image forming apparatus according to claim 6, wherein the fixing member is composed of a roller member, and the pressure member is composed of an endlessly rotating pressure belt which is in contact with an outer surface of the roller member under pressure.

* * * * *